United States Patent [19]

Ohashi et al.

[11] Patent Number: 4,585,914

[45] Date of Patent: Apr. 29, 1986

[54] MINIATURE PUSH-BUTTON SWITCH

[75] Inventors: Shigeo Ohashi; Yasushi Fujita, both of Tokyo, Japan

[73] Assignee: Nihon Kaiheiki Kogyo Kabushiki Kaisha, Japan

[21] Appl. No.: 639,992

[22] Filed: Aug. 13, 1984

[30] Foreign Application Priority Data

Sep. 29, 1983 [JP] Japan ..... 58-149688[U]

[51] Int. Cl.[4] ..... H01H 1/42

[52] U.S. Cl. ..... 200/284; 200/254; 200/314; 200/153 J

[58] Field of Search ..... 200/314, 252, 254, 284

[56] References Cited

U.S. PATENT DOCUMENTS 3,118,038 1/1964 McKnight ..... 200/314
3,663,780 5/1972 Golbeck ..... 200/314
4,239,950 12/1980 Hinze et al. ..... 200/284

FOREIGN PATENT DOCUMENTS 2246172 4/1974 Fed. Rep. of Germany ..... 200/314
2716042 10/1978 Fed. Rep. of Germany ..... 200/252

*Primary Examiner*—Stephen Marcus
*Assistant Examiner*—R. S. Kidorf
*Attorney, Agent, or Firm*—Steinberg & Raskin

[57] ABSTRACT

A miniature push-button switch having and improved switch body wherein a plurality of fixed contacts are each formed by bending an electrically conductive plate material to have one end acting as a contact portion, for contacting a movable contact which is adapted to slide in the longitudinal direction of the switch, and the other end acting as a switch terminal. The switch terminals are arranged in order along the direction substantially perpendicular to the longitudinal direction of the switch and comprise a normally open, NO, switch terminal, a common, C, switch terminal and a normally closed, NC, switch terminal interposed between the NO switch terminal and the C switch terminal.

8 Claims, 8 Drawing Figures

MINIATURE PUSH-BUTTON SWITCH

BACKGROUND OF THE INVENTION

1. Field of the Invention

This invention relates to a miniature push-button switch, and more particularly to a miniature push-button switch having an improved switch body.

2. Description of the Prior Art

Recently, there has been a highly increased demand for developing a miniature push-button switch having dimensions as small as, for example, 8 mm in diameter and 25 mm in length with the miniaturization of electrical and electronic equipments. A typical one of such miniature push-button switches is adapted to carry out the switching operation by moving a movable contact which is provided to slidingly contact fixed contacts. The fixed contacts of the miniature push-button switch of such construction generally comprise a normally closed fixed contact (hereinafter referred to as "NC fixed contact"), a common fixed contact (hereinafter referred to as "C fixed contact") and a normally opened fixed contact (hereinafter referred to as "NO fixed contact") which are arranged in order along the sliding direction of the movable contact. Also, the miniature push-button switch is constructed to include switch terminals comprising a normally closed switch terminal (hereinafter referred to as "NC switch terminal"), a normally opened switch terminal (hereinafter referred to as "NO switch terminal") and a common switch terminal (hereinafter referred to as "C switch terminal") interposed between the NC switch terminal and the NO switch terminal which are arranged to project from a switch body.

The miniature push-button switch of such construction currently used in the art is generally divided into two types. One is the type where a movable contact id slidingly moved through a switching element to electrically connect a C fixed contact and an NO fixed contact with each other through the movable contact, to thereby carry out the operation of the switch. The other is the type where the electrical connection between a C fixed contact and an NC fixed contact is accomplished without utilizing the operation of a switching element. The former type is highly predominantly used in the art.

The miniature push-button switch of the former type will be described hereinafter.

As such a miniature push-button switch, two kinds of push-button switches as shown in FIGS. 1 and 2 have been proposed and used in the art. The push-button switch shown in FIG. 1 is adapted to carry out the switching operation by means of a movable contact 221 of a clip-like shape fitted at the base portion thereof in a recess 227 formed at one side of a switching element 220 and a plurality of fixed contacts 215A, 216A and 217A. In the push-button switch of such construction, when a push button 240 is downwardly pushed, the movable contact 221 is slidingly moved while interposing the fixed contacts 215A and 216A between the contact surfaces thereof, establishing the electrical connection between the central C fixed contact 216A and the lower NO fixed contact 217A. When the push button 240 is released from the downward pressing, the switching element 220 is upwardly moved by means of the upward force of a compression coiled spring 245 interposed between a recess 228 formed at the lower surface of the switching element 220 and a sliding element 229 to allow the movable contact 221 to be upwardly moved, so that the switch is returned to the original position shown in FIG. 1.

The miniature push-button switch shown in FIG. 2 is constructed in a manner such that a projection 275 of a switching element 270 acting as the center of the pivotal movement is positioned on a receiver member (not shown) provided on a switch body 260, a movable contact 271 of a clip-like shape is securely fitted in a recess formed at the front half 270A of the switching element 270, a compression coiled spring 295 acting to upwardly force a push button 291 is positioned at one end thereof on the rear half of the switching element 270, and a plate-like operating element 279 downward extending from the lower end surface of the push button 270 is engaged with the rear half of the switching element 270. In the push-button switch of such construction, when the push button 291 is pushed for the switching operation; the switching element 270 is tilted in the left direction in FIG. 2 against the force of the compression coiled spring 295 to carry out the electrical connection between an NO fixed contact 267A on the left side and a central C fixed contact 266A through the movable contact 271. When the push button 291 is upward released; the electrical connection between the central C fixed contact and an NC fixed contact 265A on the right side is carried out through the movable contact 271 by means of the upward force of the compression coiled spring 295, so that the push-button switch is returned to the original position shown in FIG. 2.

As can be seen from the foregoing, the conventional push-button switches shown in FIGS. 1 and 2 each are constructed in the manner that the C fixed contact is arranged at the central portion of the switch, resulting in a C switch terminal being arranged between an NO switch terminal and an NC switch terminal. However, as described above, the recent miniaturization of electrical and electronic equipments requires switches to be highly miniaturized to a degree sufficient to cause the interval between the switch terminals to be as small as, for example, about 2.5 mm. This renders the soldering operation for wiring carried out with respect to the C switch terminal positioned at the central portion of the switch and the NO switch terminal arranged adjacent thereto highly troublesome and difficult. Also, this causes the switch terminals to be loosened or damaged by soldering heat, resulting in the switching operation often being impossible due to contact failure. Furthermore, in the conventional switch shown in FIG. 1, the switch terminals are arranged in the direction perpendicular to that of operating the push button. This necessarily results in the width of the switch being significantly large, to thereby cause the switch to be large-sized. Accordingly, it would be highly desirable to develop a push-button switch significantly miniaturized corresponding to the recent miniaturization of electrical and electronic equipments and operated with good reliablity.

SUMMARY OF THE INVENTION

The present invention has been made in view of the foregoing disadvantages of the prior art.

Accordingly, it is an object of the present invention to provide a miniature push-button switch having a switch body improved to a degree sufficient to highly miniaturize the switch.

It is another object of the present invention to provide a miniature push-button switch which is capable of highly readily carrying out the wiring operation with respect to switch terminals.

It is a further object of the present invention to provide a miniature push-button switch which is capable of carrying out the stable switching operation with good reliability.

It is still a further object of the present invention to provide a miniature push-button switch of which mass production is possible with a low cost.

In accordance with the present invention, there is provided a miniature push-button switch having dimensions as small as, for example, about 25 mm in length and about 8 mm in width, comprising a housing; a switching element received in said housing to be slidable in the longitudinal direction of said housing; a movable contact adapted to be moved in the longitudinal direction of said housing with the movement of said switching element; and a plurality of fixed contacts each having one end and the other end, said one end acting as a contact portion contacting with said movable contact and said the other end acting as a switch terminal; whereby a plurality of said switch terminals are arranged in order in the direction perpendicular to the longitudinal direction of said housing and comprise an NO switch terminal, a C switch terminal and an NC switch terminal interposed between said NO switch terminal and said C switch terminal.

In a preferred embodiment of the present invention, said fixed contacts each are formed by bending an electrically conductive plate material and said fixed contacts are embedded at a part thereof by molding in a switch body formed of plastic in a manner to be arranged in order in the direction perpendicular to the longitudinal direction of said housing.

BRIEF DESCRIPTION OF THE DRAWINGS

These and other objects and many of the attendant advantages of the present invention will be readily appreciated as the same becomes better understood by reference to the following detailed description when considered in connection with FIGS. 3 to 8 in the accompanying drawings in which like reference numerals designate like parts throughout, wherein.

DETAILED DESCRIPTION OF THE PREFERRED EMBODIMENTS

Now, a miniature push-button switch according to the present invention will be described in detail by way of example with reference to FIGS. 3 to 8.

Figure 1:
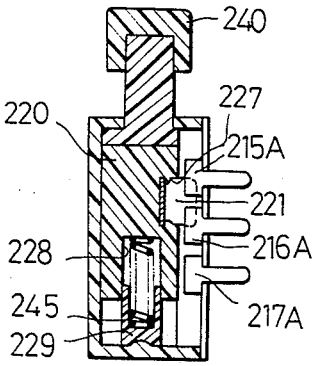
FIG. 1 (PRIOR ART)
FIG. 1 is a schematic sectional elevation view showing a miniature push-button switch conventionally used in the art.
Figure 3:
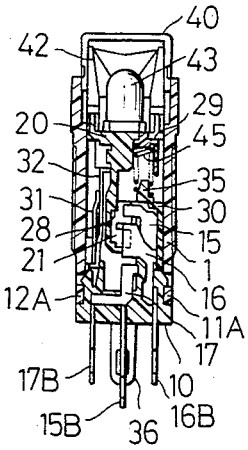
FIG. 3 is a schematic elevation view in section showing a preferred embodiment of a miniature push-button switch according to the present invention.
Figure 4:
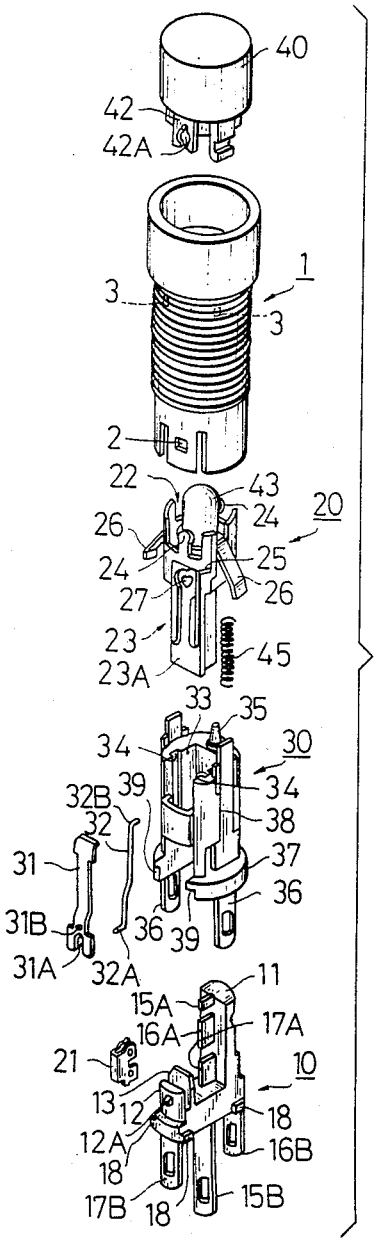
FIG. 4 is an exploded perspective view showing the essential part of the miniature push-button switch shown in FIG. 3.
Figure 2:
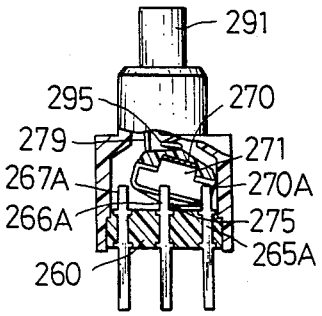
FIG. 2 (PRIOR ART)
FIG. 2 is a schematic sectional elevation view showing another conventional miniature push-button switch.

FIG. 3 is a schematic sectional elevation view showing one embodiment of a miniature push-button switch according to the present invention, and FIG. 4 is an exploded perspective view showing the essential part of the switch shown in FIG. 3.

The miniature push-button switch shown in FIGS. 3 and 4 includes a housing of a substantially cylinderical shape designated by reference numeral 1 which is opened at both upper and lower ends thereof. In the housing 1 are received a switch body 10, a lamp terminal assembly 30, and a switching element 20 through the lower end thereof. The switching element 20 is arranged in the housing 1 in a manner to be slidable in the longitudinal direction of the housing 1. The switch body 10 and the lamp terminal assembly 30 are mounted on the base end portion of the housing 1. The miniature push-button switch of the illustrated embodiment also includes a push button 40 having a push bar 42 provided therein, which is received in the housing 1 through the upper end thereof. The push bar 42 is removably fitted in the switching element 20.

Now, the switch body 10 in the miniature push-button switch of the illustrated embodiment will be first described with reference to FIGS. 3 and 4.

The switch body 10 may be formed of synthetic resin. It is integrally formed at one side end thereof (right side end) with a rising member 11 and at the other side end thereof (left side end) with a pair of projections 12 and 13. The switch body 10 also has a small projection (not shown) formed between the projections 12 and 13, which acts to engage with a cutout 31A formed at the lower end of a leaf spring 31 hereinafter described in detail. In the rising member 11 are partially embedded fixed contacts 15, 16 and 17 by molding, so that the contact portions of the fixed contacts 15, 16 and 17 are formed which are adapted to contact with a movable contact 21 hereinafter described. More particularly, the contact portions are formed in a manner to be led out from the side surface of the rising member 11 and arranged in the same direction as that of operation of the switching element 20. The fixed contacts 15, 16 and 17 are constructed in a manner such that the upper, middle and lower contact portions serve as an NC fixed contact 15A, a C fixed contact 16A and an NO contact 17A, respectively, and the other ends of the NC fixed contact 15A, C fixed contact 16A and NO fixed contact 17A act as an NC switch terminal 15B, a C switch terminal 16B and an NO switch terminal 17B, respectively. The NO switch terminal 17B, NC switch terminal 15B and C switch terminal 16B are arranged in order from the left to the right in the direction perpendicular to the longitudinal direction of the housing 1 in FIG. 4. More particularly, the NO switch terminal or normally opened switch terminal and the C switch terminal or common switch terminal are respectively positioned on the left and right sides with the NC switch terminal or normally closed switch terminal being interposed therebetween at intervals and the largest interval being defined between the NO switch terminal and the C switch terminal.

Figure 6:
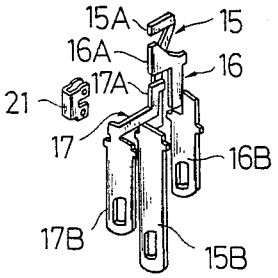
FIG. 6 is a perspective view showing the arrangement of fixed contacts and a movable contact used in the miniature push-button switch of FIG. 3.

FIG. 6 shows the structure of each of the fixed contacts and the positional relationships among the fixed contacts. As is apparent from FIG. 6, the fixed contacts 15, 16 and 17 are formed in such a manner that the extension of each of the fixed contact portions 15A, 16A and 17A adapted to contact with the movable contact 21 is perpendicular to the extension of the corresponding switch terminal 15B, 16B or 17B. More particularly, the fixed contacts 15, 16 and 17 each are formed by bending an electrically conductive plate material with one bent end thereof forming the fixed contact portion 15A (16A, 17A) and the other bent end thereof forming the switch terminal 15B (16B, 17B). The fixed contacts each are fixedly embedded at the central portion thereof in synthetic resin by molding, as shown in FIG. 4. Also, the fixed contacts are arranged in a manner to allow the central NC switch terminal 15B to somewhat downwardly project, for example, by 2 mm, as compared with the NO switch terminal 17B and the C switch terminal 16B on the both sides, as shown in FIGS. 3 and 4. The so-formed switch body 10 is fixedly fitted in the housing 1 by engaging a pair of rectangular holes 2 formed at the both sides of the lower portion of the housing 1 with projections 11A (FIG. 3) and 12A respectively formed on the outer side surface of the upper portion of the rising member 11 and the outer side surface of the upper portion of the upward projection 12 of the switch body 10.

The illustrated embodiment having the switch body 10 constructed in the manner described above can effectively allow a push-button switch of the so-called NO type much in demand, in which the wiring is formed with respect to a NO switch terminal 17B and a C switch terminal 16B, to be significantly miniaturized, because it is possible to arrange three terminals 17B, 15B and 16B at short intervals as small as, for example, 2 mm. Also, the miniature push-button switch of the illustrated embodiment permits the soldering operation for wiring to be readily carried out in a short time, because there is provided a relatively long interval between the switch terminals 17B and 16B. This effectively avoids the looseness or damage of the switch terminals due to soldering heat. In the manufacturing of a printed board, the use of a push-button switch in which switch terminals are arranged at short intervals and the switch terminals are positioned at the central portion of the switch renders the manufacturing substantially difficult and is apt to cause trouble such as the peeling of a land, because the area of the land in the printed board is substantially small. On the contrary, the push-button switch of the illustrated embodiment is constructed to arrange the NC switch terminal of low frequency in use at the central portion of the switch body, to thereby allow the distance between the C switch terminal and the NO switch terminal to be large. This results in the manufacturing of a printed board being readily carried out and a trouble such as the peeling of a land being effectively prevented.

In the illustrated embodiment, the switching element 20 comprises an upper half acting as a receiver section 22 for supporting therein an illuminant 43 such as a light emitting diode or the like and a lower half which serves as a holder section 23 for holding the movable contact 21 formed of a resilient plate material into a clip-like shape and supporting a switching mechanism of the switch. In the illustrated embodiment, the receiver section 22 and holder section 23 are integrally formed. The receiver section 22 is formed with guide holes (not shown) for guiding terminals of the illuminant 43 therethrough which is downward inserted in the receiver section 22, and has side walls for surrounding the illuminant 43. The side walls of the receiver section 22 opposite to each other are formed at the upper portions thereof with a pair of projections 24 which are adapted to be detachably engaged with a pair of recesses 42A formed by plate members downwardly extending from the both sides of the push bar 42 fixedly fitted in the push button 40. Also, the side wall of the receiver section 22 is formed at the substantially central portion thereof along the vertical direction with an upward step 25 which acts to prevent the switching element 20 from being upwardly removed from the housing 1 due to the upward force of the compression coiled spring 45. The upward step 25 is adapted to abut against projections 3 (FIG. 4) formed on the inner surface of the housing 1 to prevent the upward removal of the switching element 20. Also, in the receiver section 22 are securely inserted a pair of lamp fitments 26 downward from the upper end of the receiver section 22. The lamp fitments 26 each are arranged in a manner to be contacted with the inner side of the upper end of a lamp terminal 36 corresponding thereto. The holding section 23 is formed on the left side thereof in FIG. 4 with a heart-shape cam 27. Reference numeral 32 designates a hook pin having one end 32A bent and securely fitted in a small hole 31B formed at the lower portion of the leaf spring 31 and the other end or free end 32B slidably engaged with the heart-shape cam 27 under back pressure due to the leaf spring 31. Also, the holder section 23 is formed on the right side surface thereof with a recess 28 for holding the movable contact 21 (FIG. 3). The movable contact 21 held at a part thereof in the recess 28 is adapted to slidedly contact with the fixed contacts 15A, 16A and 17A in a manner to interpose the fixed contacts between the contact surfaces thereof.

As described above, in the illustrated embodiment, the switching element 20 has the leaf spring 31 and hook pin 32 arranged on the left side of the holder section 23 thereof and the movable contact 21 and compression coiled spring 45 arranged on the right side thereof, so that the upward force generated by the hook pin 32 under back pressure of the leaf spring 31 may allow the switching element 20 to be uniformly forced upwardly in cooperation with the upward force of the compression coiled spring 45. This results in the switching element 20 being smoothly slidable in the housing in the longitudinal direction of the housing 1. Also, this allows the switch to be quickly and positively operated without loss in force as well as to have sharp operating characteristics.

Figure 5:
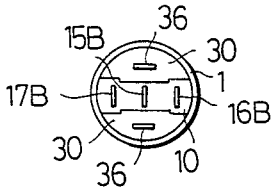
FIG. 5 is a bottom view of the miniature push-button switch shown in FIG. 3.

The terminal assembly 30 may be formed of synthetic resin. The terminal assembly 30 has a hollow section 33 formed through the substantially central portion thereof which is adapted to receive therein the rising member 11 of the switch body 10, the holder section 23 of the switching element 20, the leaf spring 31 and the hook pin 32. The hollow section 33 is formed on the inner side surfaces thereof opposite to each other with a pair of vertically extending grooves 34 for guiding the holder section 23 of the switching element 20. Also, the terminal assembly 30 is provided on the top surface thereof with a projection 35 for supporting or receiving one end of the compression coiled spring 45 interposed between a projection 29, provided to downwardly project from the lower end of one of the projections 24 of the switching element 20, and the projection 35. The terminal assembly 30 also has a pair of the above-mentioned lamp terminals 36 vertically extending through a base plate 37 of the terminal assembly 30. The lamp terminals 36 are fitted at the upper portions thereof in vertically extending recesses 38 formed at the side walls of the terminal assembly 30 opposite to each other. Also, the lamp terminals 36 each are adapted to contact at the upper portion thereof with the lamp fitment 26. The mounting of the switch body 10 and terminal assembly 30 in the housing 1 is carried out by engaging a pair of projections 18 formed on the both sides of the switch body 10 with a pair of recesses 39 formed in the base plate 37 of the terminal assembly 30 and further engaging the projections 11A and 12A provided on the switch body 10 with the rectangular holes 2 of the housing 1. Thus, it will be noted that when viewing the so-assembled push-button switch from the bottom side thereof, the direction in which the lamp terminals 37 are arranged is perpendicular to that in which the switch terminals 17B, 15B and 16B are arranged, as shown in FIG. 5. Accordingly, the present embodiment is capable of providing a miniature push-button switch having switch terminals arranged in a highly rational manner.

Now, the manner of operation of the embodiment described above will be described hereinafter with reference to FIGS. 3 to 6.

When the push button 40 is downwardly pushed, the switching element 20 coupled with the push bar 42 securely fitted in the push button 40, is downwardly moved against the upward force of the compression coiled spring 45, to thereby allow the movable contact 21 fixed on the switching element 20 to be downwardly moved together with the element 20. Concurrently, the free end 32B of the hook pin 32 is slidingly guided on the heart-shaped cam 27. This results in the formation of the connection between the NC fixed contact 15A and the C fixed contact 16A through the movable contact 21 (FIG. 3) being changed to the formation of the connection between the C fixed contact 16A and the NO fixed contact 17A through the movable contact 21. In this state, even when the force downwardly pressing the push button 40 is released, the switching element 20 is kept locked resulting in the vertical movement being prevented, because the hook pin 32 is held by the heart-shaped cam 27. Then, when the push-button 40 is further pushed, the hook pin 32 is released from the engagement with the heart-shaped cam 27 to allow the switching element 20 and movable contact 21 to be upwardly moved due to the upward force of the compression coiled spring 45, so that the switch may be finally returned to the original state shown in FIG. 3.

Figure 7:
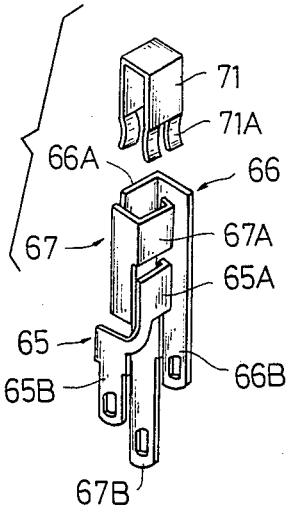
FIG. 7 is a perspective view showing a modification of construction and arrangement of fixed contacts and a movable contact in a miniature push-button switch according to the present invention.
Figure 8:
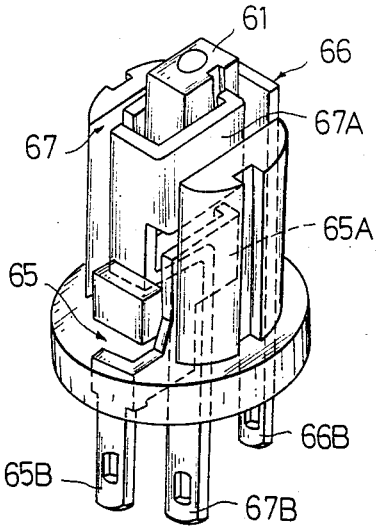
FIG. 8 is an enlarged perspective view of a switch body including the fixed contacts shown in FIG. 7.

FIG. 7 shows a modification of the fixed contacts and movable contact constituting the switch body shown in FIG. 6. In the modification shown in FIG. 7, a fixed contact 65 (66, 67) is formed to have a contact portion 65A (66A, 67A) contacting with a movable contact 71 and a switch terminal 65B (66B, 67B) by bending an electrically conductive plate material, as in the embodiment described above. Also, the NO switch terminal 65B, NC switch terminal 67B and C switch terminal 66B are arranged in order from the left to the right in FIG. 7, as in the embodiment described above. However, the modification of FIG. 7 is different from the embodiment described above in that the NC fixed contact 67 and NO fixed contact 65 are vertically arranged opposite to the C fixed contact 66 and the outer surface of one end of each of the fixed contacts serves as a contact portion contacting with the movable contact 71. Also, in the modification, the movable contact 71 may be constructed in a manner to be fitted in a recess formed at the lower end surface of a switching element (not shown) to be moved with the switching element. For this purpose, the movable contact 71 is formed into a substantially inverted U-shape and is provided at the lower ends thereof with resilient contactors 71A which are adapted to slidingly contact the outer side surfaces of the contact portions 65A, 66A and 67A of the fixed contacts 65, 66 and 67. Furthermore, the fixed contacts of the modification are arranged to surround together a cylindrical member 61 for preventing the deformation of the contacts and supporting them, as shown in FIG. 8.

As can be seen from the foregoing, the miniature push-button switch of the present invention constructed in the manner as described above can readily carry out the wiring operation and the manufacturing of a printed board, and effectively prevent a trouble such as the peeling of a land, because the switch terminals of high frequency in use are arranged to be spaced at a large interval from each other.

Also, the present invention can effectively prevent the looseness and damage of the switch terminals due to soldering heat to ensure the reliable switching operation, because the wiring between the switch terminals is readily carried out in a short time.

Further, the miniature push-button switch of the present invention is constructed to allow the switching element for carrying out the switching operation to be smoothly slided in the housing in the longitudinal direction of the housing, to thereby be lightly operated with good efficiency.

Furthermore, in the present invention, the parts are functionally and rationally arranged to a degree sufficient to provide a subminiature push-button switch having dimensions as small as, for example, 8 mm in diameter and 25 mm in length and an illuminating function.

It will thus be seen that the objects of the present invention set forth above, among those other objects made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention, which, as a matter of language, might be said to fall therebetween.

What is claimed is:

1. A miniature push-button switch comprising:

a housing;

first, second and third contact members comprising a normally open, NO, contact member, a normally closed, NC, contact member and a common, C, contact member, respectively, which are arranged in fixed positions within the housing substantially along a line extending in a longitudinal direction of the housing;

first, second and third terminal members comprising a NO terminal member, a NC terminal member and a C terminal member respectively, which are connected to the respective contact members and are arranged within the housing substantially along a line perpendicular to the longitudinal direction, said second terminal member being positioned between said first and said third terminal members;

a movable contact member which is movable within the housing in a longitudinal direction in contact with the contact members such that the movable contact member couples said third contact member and said second contact member in a first position, and said movable contact member couples said third contact member and said first contact member in a second position;

a switching element for moving said movable contact member, said switching element being movable within said housing in the longitudinal direction; and a push button for moving said switching element, said push button being arranged in one end portion of said housing and being movable in the said longitudinal direction, wherein said switching element is moved from said first position to said second position by pushing said push button, said contact members and said respective terminal members are integrally formed by an electrically conductive plate material such that surfaces of said contact members are substantially perpendicular to surfaces of said terminal members, and said terminal members composed of the electrically conductive plate material are arranged substantially in parallel with one another.

2. The switch of claim 1, wherein said second and first contact members are each disposed opposite said third contact member in a direction substantially perpendicular to the longitudinal direction.

3. The switch of claim 1, wherein said fixed contact members and said movable contact member are arranged over said terminal members.

4. The switch of claim 3, wherein said respective integral members composed of said respective contact members and terminal members, are partially embedded in a switch body formed of synthetic resin material.

5. The switch of claim 4, wherein said third contact member is positioned between said first contact member and said second contact member.

6. The switch of claim 5, comprising switching element control means for controlling said switching element such that said switching element may be maintained in said second position in an ON mode and said switching element may be released from said second position to said first position when changing from an ON mode to an OFF mode, by movement of said push button.

7. The switch of claim 6, further including illuminating means comprising an illuminant mounted on said switching element, a pair of fitments mounted on said switching element, formed of an electrically conductive material, and electrically connected to said illuminant, and a pair of illuminant terminals, said fitments being contacted by said illuminant terminals in said second position of said switching element, and being separated from the same in said first position thereof.

8. The switch of claim 7, wherein said illuminant terminals are held by an illuminant terminal assembly disposed within said housing.

* * * * *